US010686276B2

(12) United States Patent
Li

(10) Patent No.: US 10,686,276 B2
(45) Date of Patent: Jun. 16, 2020

(54) CABLE CONNECTOR ASSEMBLY AND MANUFACTURING METHOD THEREOF

(71) Applicant: Yong Tai Electronic(DONGGUAN) Ltd., Dongguan (CN)

(72) Inventor: Yu-Sheng Li, Dongguan (CN)

(73) Assignee: YONG TAI ELECTRONIC (DONGGUAN) LTD., Dongguan (CN)

( * ) Notice: Subject to any disclaimer, the term of this patent is extended or adjusted under 35 U.S.C. 154(b) by 0 days.

(21) Appl. No.: 16/414,825

(22) Filed: May 17, 2019

(65) Prior Publication Data

US 2019/0356078 A1 Nov. 21, 2019

(30) Foreign Application Priority Data

May 17, 2018 (CN) ..... 2018 1 0476358

(51) Int. Cl.

| | |
|---|---|
| ***H01R 13/504*** | (2006.01) |
| ***H01R 12/70*** | (2011.01) |
| ***H01R 13/58*** | (2006.01) |
| ***H01R 43/18*** | (2006.01) |
| ***H01R 43/20*** | (2006.01) |
| *H01R 12/72* | (2011.01) |

(52) U.S. Cl.

CPC ..... *H01R 13/504* (2013.01); *H01R 12/707* (2013.01); *H01R 13/5845* (2013.01); *H01R 43/18* (2013.01); *H01R 43/205* (2013.01); *H01R 12/722* (2013.01)

(58) Field of Classification Search

CPC ..... H01R 13/504

See application file for complete search history.

(56) References Cited

U.S. PATENT DOCUMENTS

| | | | | |
|---|---|---|---|---|
| 9,520,673 | B2 * | 12/2016 | Xing | H01R 13/5845 |
| 9,583,889 | B2 * | 2/2017 | Wu | H01R 13/6593 |
| 9,705,241 | B2 * | 7/2017 | Wu | H01R 13/5845 |
| 9,768,561 | B2 * | 9/2017 | Hsu | H01R 12/515 |
| 9,819,128 | B2 * | 11/2017 | Zhou | H01R 13/7175 |
| 9,825,407 | B2 * | 11/2017 | Wu | H01R 13/6581 |
| 9,843,143 | B2 * | 12/2017 | Wu | H01R 13/665 |
| 9,979,145 | B2 * | 5/2018 | Wu | H01R 24/60 |
| 9,990,320 | B2 * | 6/2018 | Cheng | H01R 13/6597 |
| 10,027,069 | B2 * | 7/2018 | Huang | H01R 13/504 |
| 10,084,254 | B2 * | 9/2018 | Ge | H01R 13/2442 |

(Continued)

*Primary Examiner* — Ross N Gushi

(74) *Attorney, Agent, or Firm* — WPAT, PC

(57) ABSTRACT

A cable connector assembly and the manufacturing method thereof are disclosed in the invention. The cable connector assembly includes a plug connector including a conductive module and a metal casing having a fixing and a mating section; a printed circuit board being electrically connected to the plug connector and a cable assembly which includes a wire retainer, wires, and an insulating layer; an inner casing being insert-molded onto the printed circuit board, the wire retainer, and the fixing section; a stress releasing element being insert-molded onto the insulating layer and partially onto the inner casing; and an outer casing being insert-molded onto the inner casing and partially onto the stress releasing element. The cable connector assembly is produced without the pin, no pin holes will be formed on the outer casing. The cable connector assembly is easy to produce and aesthetically pleasing and can meet stricter requirement of the client.

10 Claims, 6 Drawing Sheets

(56) References Cited

U.S. PATENT DOCUMENTS

| | | | | |
|---|---|---|---|---|
| 10,116,101 | B2 * | 10/2018 | Huang | H01R 13/6608 |
| 10,177,503 | B2 * | 1/2019 | Zou | H01R 13/504 |
| 10,348,010 | B2 * | 7/2019 | Wu | H01R 12/775 |
| 10,498,090 | B2 * | 12/2019 | Wu | H01R 13/6594 |
| 2015/0126069 | A1 * | 5/2015 | Little | H01R 24/60 439/607.55 |
| 2016/0079689 | A1 * | 3/2016 | Wu | B23K 1/0016 439/581 |
| 2016/0141803 | A1 * | 5/2016 | Hsu | H01R 24/60 439/607.55 |
| 2016/0141817 | A1 * | 5/2016 | Wu | H01R 24/60 439/676 |
| 2016/0322761 | A1 * | 11/2016 | Wu | H01R 13/7175 |
| 2018/0375232 | A1 * | 12/2018 | Wu | H01R 4/182 |
| 2019/0021185 | A1 * | 1/2019 | Ju | G06F 1/20 |
| 2019/0052032 | A1 * | 2/2019 | Wu | H01R 12/725 |
| 2019/0267764 | A1 * | 8/2019 | Wu | H01B 7/0861 |

* cited by examiner

CABLE CONNECTOR ASSEMBLY AND MANUFACTURING METHOD THEREOF

RELATED APPLICATIONS

This application claims priority to China Patent Application, No. 201810476358.X, by Li, titled "Cable Connector Assembly and Manufacturing method thereof," filed on May 17, 2018, which is hereby incorporated by reference herein in their entirety.

BACKGROUND OF THE INVENTION

Technical Field

The present invention relates to a cable connector assembly and a manufacturing method thereof.

Description of Related Art

With the development of the electronics industry, cables have been widely used for the purposes of data transmission and communication and already become an essential part of our daily life. A cable connector assembly is disclosed in the Chinese patent publication of publication number CN102412474. The cable connector assembly includes a stress releasing component which is formed outside the cable and a sleeve which is disposed outside the metal inner casing and the stress releasing component. While forming the cable connector assembly, a pin is added to the tail to fix the cable, so a pin hole will be naturally left on the outer casing, which affects the appearance and the performance of the product.

Therefore, in view of the above-mentioned problems, it is necessary to design a new cable connector and a method of manufacturing the same to overcome the above-mentioned drawbacks.

SUMMARY

The invention provides a cable connector assembly which is easy to produce and aesthetically pleasing, and a manufacturing method thereof.

The cable connector assembly of the present invention is used for coupling to a socket connector and includes a plug connector, a printed circuit board, a cable assembly, an inner casing, a stress releasing element, and an outer casing. The plug connector includes a conductive module and a metal casing covering the conductive module and the conductive module is electrically connected to the socket connector, and the metal casing includes a fixing section and a mating section connecting with the fixing section. The printed circuit board is electrically connected to the conductive module. The cable assembly is electrically connected to the printed circuit board, and the cable assembly includes a wire retainer, several wires that are arranged at the wire retainer, and an insulating layer covering the wires. The inner casing is insert-molded onto the printed circuit board, the wire retainer, and the fixing section. The stress releasing element is insert-molded onto the insulating layer and partially onto the inner casing. The outer casing is insert-molded onto the inner casing and partially onto the stress releasing element.

The manufacturing method of the cable connector assembly of the present invention at least includes the following steps: (1) providing a plug connector and a printed circuit board, soldering the plug connector to the printed circuit board such that they are electrically connected, wherein the plug connector includes a conductive module and a metal casing covering the conductive module, and the metal casing includes a fixing section and a mating section connecting with the fixing section; (2) providing a cable assembly, soldering the cable assembly to the printed circuit board such that they are electrically connected, wherein the cable assembly includes a wire retainer, several wires that are arranged at the wire retainer, and an insulating layer covering the wires; (3) inject-molding an inner casing such that the inner casing is insert-molded onto the printed circuit board, the wire retainer, and the fixing section; (4) inject-molding a stress releasing element such that the stress releasing element is insert-molded onto the insulating layer and partially onto the inner casing; and (5) inject-molding an outer casing such that the outer casing is insert-molded onto the inner casing and partially onto the stress releasing element.

The cable connector assembly and the manufacturing method thereof of the present invention have the following beneficial effects:

The inner casing, the stress releasing element, and the outer casing of the cable connector assembly of the present invention are formed by insert-molding respectively. The production can be completed without adding the pin, so no pin holes will be formed on the outer casing. Therefore, the cable connector assembly of the present invention is easy to produce and is aesthetically pleasing and can meet stricter requirement of the client.

BRIEF DESCRIPTION OF DRAWINGS

The invention can be more fully understood by reading the following detailed description of the embodiment, with reference made to the accompanying drawings as follows.

DETAILED DESCRIPTION

Reference will now be made in detail to elaborate the technical features for achieving the objects of the embodiments of the present invention with accompanying drawings and embodiments. Those skilled in the art can understand that the directional terms provided in the specific embodiments of the invention, such as up, down, left, right, front, back . . . etc., are only used for elaboration with reference to the direction of the accompanying drawings and are not intended to limit the invention. In addition, a variety of alternations and modifications can be made by those skilled in the art without departing from the spirit and the scope of the invention, and such derived embodiments will also fall within the scope of the invention.

Figure 1:
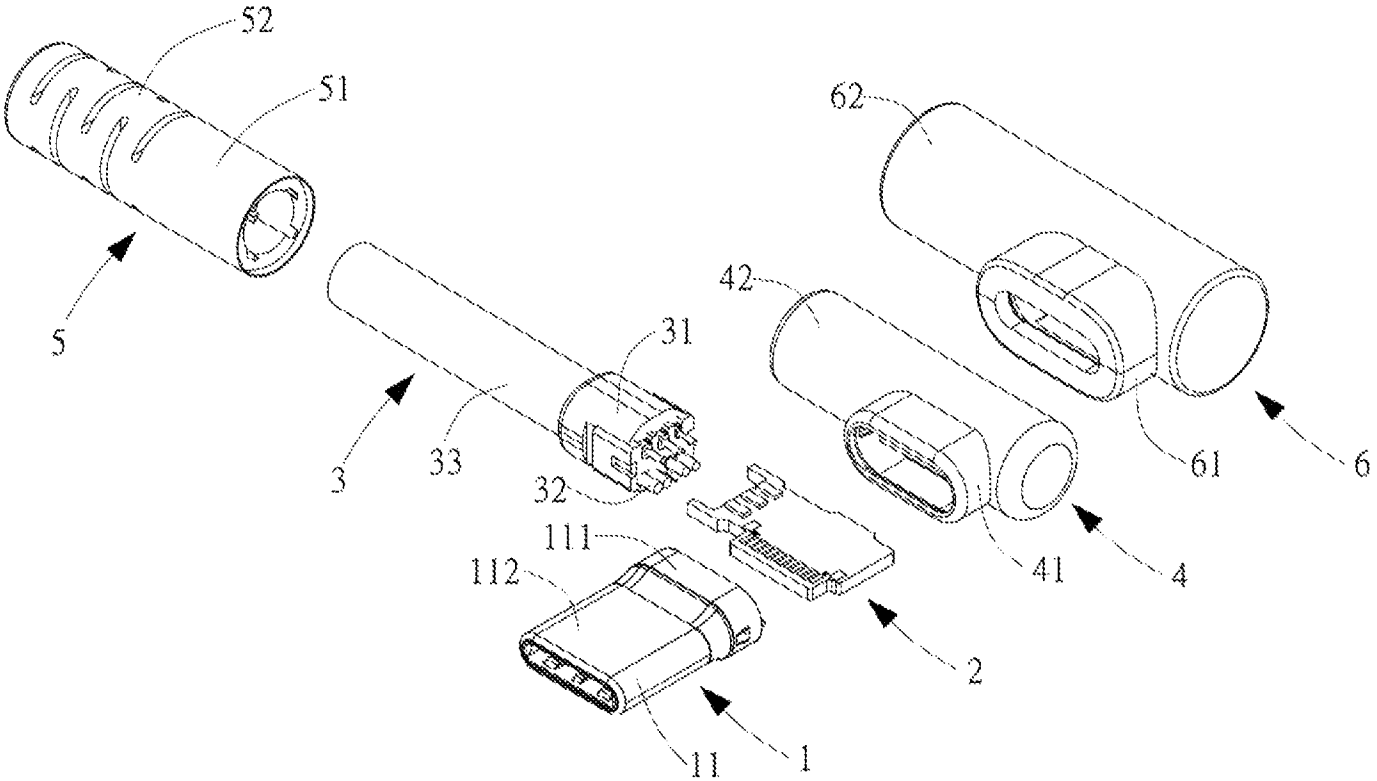
FIG. 1 is a three-dimensional exploded view of the cable connector assembly of the present invention.
Figure 2:
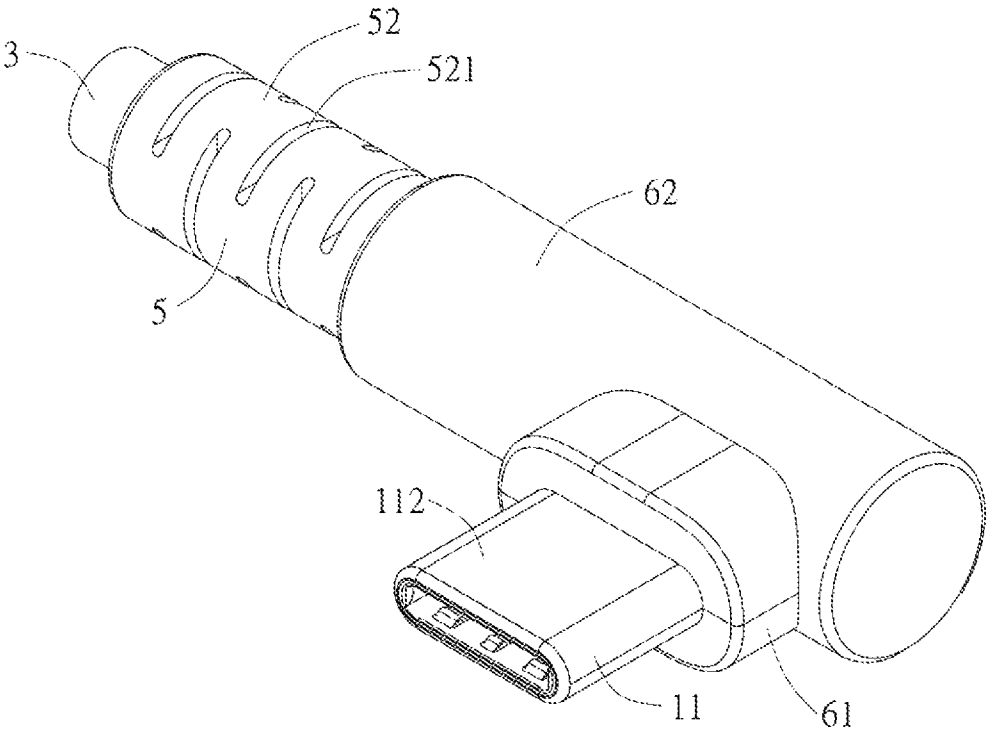
FIG. 2 is a three-dimensional view of the cable connector assembly of the present invention.

Please refer to FIG. 1 and FIG. 2, FIG. 1 is a three-dimensional exploded view of the cable connector assembly of the present invention, and FIG. 2 is a three-dimensional view of the cable connector assembly of the present invention. The cable connector assembly of the present invention is used for coupling to a socket connector (not shown). The cable connector assembly of the present invention includes a plug connector 1, a printed circuit board 2 being electrically connected to the plug connector 1, a cable assembly 3 being electrically connected to the printed circuit board 2, and an inner casing 4, a stress releasing element 5, and an outer casing 6 that are respectively formed by insert-molding.

The plug connector 1 includes a conductive module (not shown) and a metal casing 11 covering the conductive module (not shown). The conductive module (not shown) is electrically connected to the socket connector (not shown) and the printed circuit board 2. The metal casing 11 includes a fixing section 111 and a mating section 112 connecting with the fixing section 111.

The cable connector assembly 3 is electrically connected to the printed circuit board 2, and an extending direction of the cable assembly 3 is perpendicular to an inserting direction of the plug connector 1. The cable assembly includes a wire retainer 31, several wires 32 that are arranged at the wire retainer 31, and an insulating layer 33 covering the wires 32.

Figure 3:
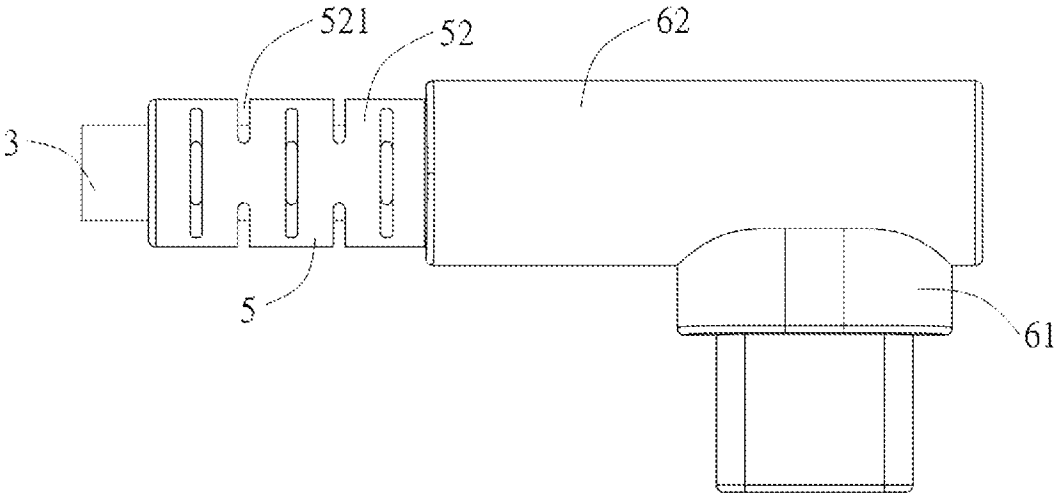
FIG. 3 is a top view of the cable connector assembly of the present invention.
Figure 4:
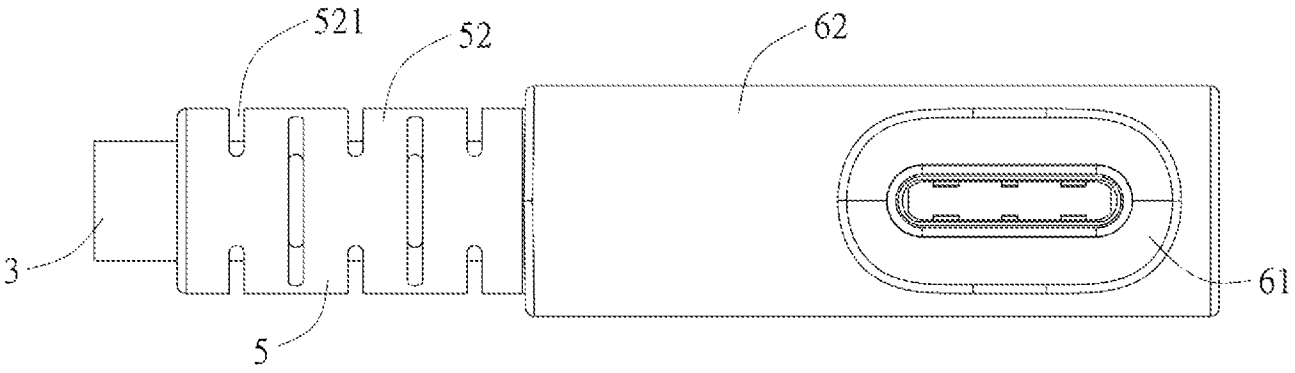
FIG. 4 is a front view of the cable connector assembly of the present invention.
Figure 5:
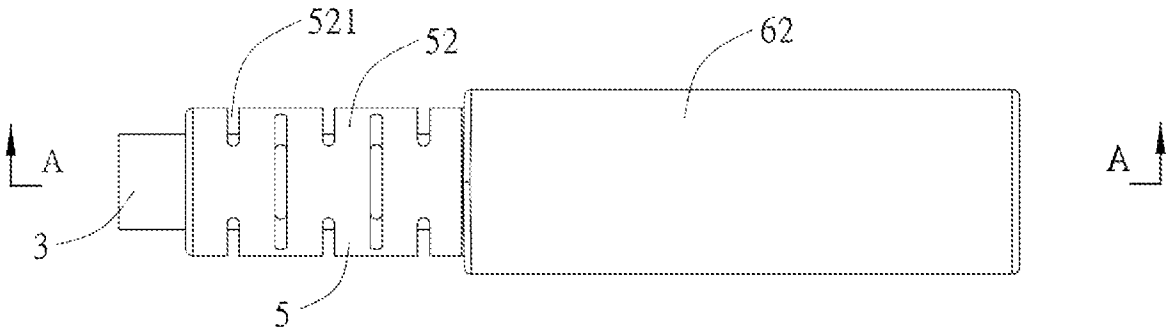
FIG. 5 is a rear view of the cable connector assembly of the present invention.

Please refer to FIG. 3 to FIG. 6, the inner casing 4 is insert-molded onto the printed circuit board 2, the wire retainer 31, and the fixing section 111. The inner casing 4 is made of rigid material. The inner casing 4 includes a first receiving section 41 and a second receiving section 42 connecting with the first receiving section 41. The fixing section 111 is disposed in the first receiving section 41, and the printed circuit board 2 and the wire retainer 31 are disposed in the second receiving section 42. As shown in FIG. 2 and FIG. 3, the intersection of the first receiving section 41 and the second receiving section 42 is curved.

Figure 6:
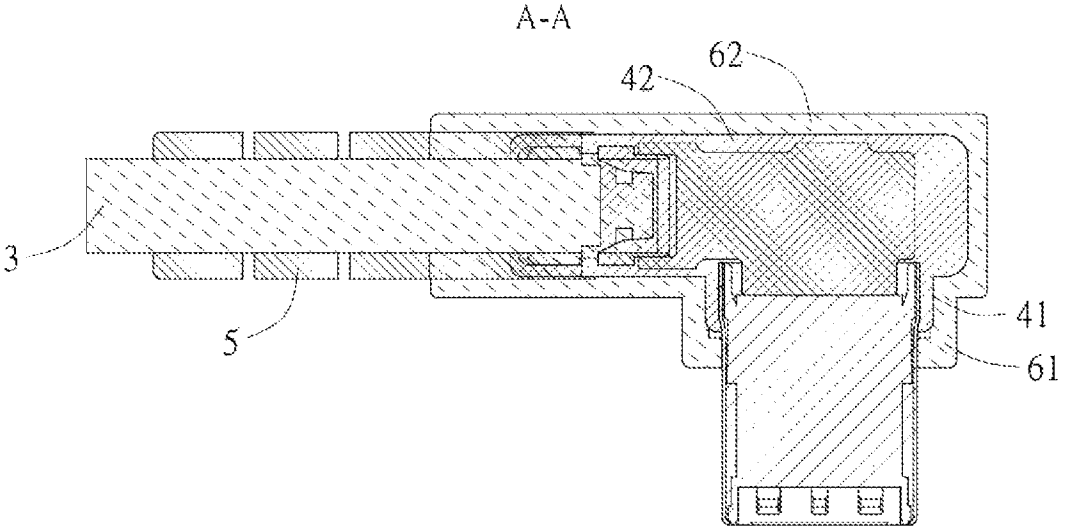
FIG. 6 is a cross-sectional view of the cable connector assembly of FIG. 5 taken along direction A-A.

Please refer to FIG. 6, the stress releasing element 5 is insert-molded onto the insulating layer 33 and partially onto the inner casing 4. The inner casing 4 is partially overlapped with the stress releasing element 5 in the extending direction of the cable assembly 3. The stress releasing element 5 includes a non-stress section 51 and a stress section 52 connecting with the non-stress section 51. Several stress grooves 521 are provided on the stress section 52, and the outer casing 6 is insert-molded onto the non-stress section 51.

The outer casing 6 is insert-molded onto the inner casing 4 and partially onto the stress releasing element 5. In the present embodiment, the outer casing 6 and the stress releasing element 5 are made of the same material. The outer casing 6 and the stress releasing element 5 are made of soft material. The material hardness of the inner casing 4 is greater than the material hardness of the outer casing 6. The outer casing 6 includes a third receiving section 61 and a fourth receiving section 62 connecting with the third receiving section 61. As shown in FIG. 2 and FIG. 3, the intersection of the third receiving section 61 and the fourth receiving section 62 is curved. The third receiving section 61 and the first receiving section 41 have the same shape but different sizes, and the fourth receiving section 62 and the second receiving section 42 have the same shape but different sizes. In the present embodiment, the first receiving section 41 is perpendicular to the second receiving section 42, and the third receiving section 61 is perpendicular to the fourth receiving section 62.

The manufacturing method of the above-mentioned cable connector assembly includes at least the following steps:

(1) providing the plug connector 1 and the printed circuit board 2, soldering the plug connector 1 to the printed circuit board 2 such that they are electrically connected, in which, the plug connector includes the conductive module (not shown in the figures) and the metal casing 11 covering the conductive module (not shown in the figures), and the metal casing 11 includes the fixing section 111 and the mating section 112 connecting with the fixing section 111;

(2) providing the cable assembly 3, soldering the cable assembly 3 to the printed circuit board 2 such that they are electrically connected, in which, the cable assembly 3 includes the wire retainer 31, several wires 32 arranged at the wire retainer 31, and the insulating layer 33 covering the wires 32;

(3) inject-molding the inner casing 4 such that the inner casing 4 is insert-molded onto the printed circuit board 2, the wire retainer 31, and the fixing section 111;

(4) inject-molding the stress releasing element 5 such that the stress releasing element 5 is insert-molded onto the insulating layer 33 and partially onto the inner casing 4, and the inner casing 4 is partially overlapped with the stress releasing element 5 in the extending direction of the cable assembly 3; and (5) inject-molding the outer casing 6 such that the outer casing 6 is insert-molded onto the inner casing 4 and partially onto the stress releasing element 5.

In the cable connector assembly of the present invention, the inner casing, the stress releasing element, and the outer casing are formed by insert-molding respectively, and the production can be completed without adding the pin, so no pin holes will be formed on the outer casing. Therefore, the cable connector assembly of the present invention is easy to produce and is aesthetically pleasing and can meet stricter requirement of the client.

The above description only reflects the preferred embodiments of the present invention and is not intended to limit the invention in any way. Although the preferred embodiments have been disclosed, they are not intended to limit the invention. Those skilled in the related art can make some alternations or modifications, without departing from the scope of the technical solutions of the invention, to achieve equivalent embodiments by using the above-disclosed technical contents. Yet any simple modifications, equivalent changes and modifications made to the above-mentioned embodiments, without departing from the content of the technical solutions of the invention, still fall within the scope of the technical solutions of the present invention.

What is claimed is:

1. A cable connector assembly for coupling to a socket connector, comprising:

a plug connector, the plug connector comprising a conductive module and a metal casing covering the conductive module, the conductive module being electrically connected to the socket connector, and the metal casing comprising a fixing section and a mating section connecting with the fixing section;

a printed circuit board, the printed circuit board being electrically connected to the conductive module;

a cable assembly, the cable assembly being electrically connected to the printed circuit board, and the cable assembly comprising a wire retainer, a plurality of wires arranged at the wire retainer, and an insulating layer covering the wires;

an inner casing, the inner casing being insert-molded onto the printed circuit board, the wire retainer, and the fixing section;

a stress releasing element, the stress releasing element being insert-molded onto the insulating layer and partially onto the inner casing; and an outer casing, the outer casing being insert-molded onto the inner casing and partially onto the stress releasing element.

2. The cable connector assembly according to claim 1, wherein the stress releasing element comprises a non-stress section and a stress section connecting with the non-stress section, a plurality of stress grooves are provided on the stress section, and the outer casing is insert-molded onto the non-stress section.

3. The cable connector assembly according to claim 1, wherein the inner casing is partially overlapped with the stress releasing element in an extending direction of the cable assembly.

4. The cable connector assembly according to claim 1, wherein the inner casing comprises a first receiving section and a second receiving section connecting with the first receiving section, the fixing section is disposed in the first receiving section, and the printed circuit board and the wire retainer are disposed in the second receiving section.

5. The cable connector assembly according to claim 4, wherein the outer casing comprises a third receiving section and a fourth receiving section connecting with the third receiving section, the third receiving section and the first receiving section have the same shape but different sizes, and the fourth receiving section and the second receiving section have the same shape but different sizes.

6. The cable connector assembly according to claim 5, wherein the intersection of the first receiving section and the second receiving section is curved, and the intersection of the third receiving section and the fourth receiving section is curved.

7. The cable connector assembly according to claim 6, wherein the first receiving section is perpendicular to the second receiving section, and the third receiving section is perpendicular to the fourth receiving section.

8. A manufacturing method of a cable connector assembly comprising at least the following steps:

(1) providing a plug connector and a printed circuit board, soldering the plug connector to the printed circuit board such that they are electrically connected, wherein the plug connector comprises a conductive module and a metal casing covering the conductive module, and the metal casing comprises a fixing section and a mating section connecting with the fixing section;

(2) providing a cable assembly, soldering the cable assembly to the printed circuit board such that they are electrically connected, wherein the cable assembly comprises a wire retainer, a plurality of wires arranged at the wire retainer, and an insulating layer covering the wires;

(3) inject-molding an inner casing such that the inner casing is insert-molded onto the printed circuit board, the wire retainer, and the fixing section;

(4) inject-molding a stress releasing element such that the stress releasing element is insert-molded onto the insulating layer and partially onto the inner casing; and (5) inject-molding an outer casing such that the outer casing is insert-molded onto the inner casing and partially onto the stress releasing element.

9. The manufacturing method of the cable connector assembly according to claim 8, wherein the inner casing and the outer casing have the same shape but different sizes.

10. The manufacturing method of the cable connector assembly according to claim 8, wherein the inner casing is partially overlapped with the stress releasing element in an extending direction of the cable assembly.

* * * * *